US006447401B1

(12) United States Patent
Torkos

(10) Patent No.: US 6,447,401 B1
(45) Date of Patent: Sep. 10, 2002

(54) GOLF CLUB ALIGNMENT DEVICE

(75) Inventor: Christos Torkos, Toronto (CA)

(73) Assignee: Torkos Brothers Inc., Toronto (CA)

( * ) Notice: Subject to any disclaimer, the term of this patent is extended or adjusted under 35 U.S.C. 154(b) by 35 days.

(21) Appl. No.: 09/616,381

(22) Filed: Jul. 13, 2000

(51) Int. Cl.[7] ..... A63B 69/36
(52) U.S. Cl. ..... 473/226; 473/201
(58) Field of Search ..... 473/300, 316, 473/201, 206, 219, 226, 227

(56) References Cited

U.S. PATENT DOCUMENTS

| | | | | | |
|---|---|---|---|---|---|
| 1,488,900 | A | * | 4/1924 | Armstrong | 473/201 |
| 1,604,696 | A | * | 10/1926 | Jordy | 473/201 |
| 2,865,635 | A | * | 12/1958 | Jessen | 473/201 |
| 4,136,877 | A | | 1/1979 | Antonious | |
| 4,167,268 | A | | 9/1979 | Lorang | |
| 4,413,824 | A | | 11/1983 | King et al. | |
| 4,872,684 | A | | 10/1989 | Dippel | |
| 4,928,971 | A | | 5/1990 | Soles, Jr. | |
| 5,058,891 | A | * | 10/1991 | Takeuchi | 473/201 |
| 5,158,297 | A | * | 10/1992 | Johnson | 473/201 X |
| 5,441,274 | A | * | 8/1995 | Clay | 473/201 |
| 5,564,990 | A | | 10/1996 | Weeks | |
| 5,665,007 | A | | 9/1997 | Tatum | |
| D404,450 | S | | 1/1999 | Weeks | |
| 6,022,278 | A | * | 2/2000 | Vela | 473/201 |

FOREIGN PATENT DOCUMENTS

CA 1160043 1/1984

* cited by examiner

*Primary Examiner*—Raleigh W. Chiu
(74) *Attorney, Agent, or Firm*—Ridout & Maybee LLP

(57) ABSTRACT

A golf club alignment device to be secured to an outer surface of a golf club shaft. The device comprises a band of material having first and second markings positioned at first and second ends of a central portion, the markings being of contrasting visual appearance relative to the central portion of the band, with the markings preferably being light in colour and the central portion of the band preferably being dark in colour. The contrasting visual appearance of the markings and the central portion create visual transition points between the markings and the central portion of the band. The transition points between the markings and the central portion of the band are spaced apart by a distance such that, when the band is applied to the cylindrical surface of the golf club shaft with the center point of the central portion coincident with the rearmost point of the shaft, the transition points are located at 180 degrees to one another and at 90 degrees to the rearmost point on the shaft. When the device is installed on the golf club shaft, the central portion of the band extends about the rear face of the shaft, while the contrasting markings wrap around the front face of the shaft. The golfer aligns the club by sighting down along the front face of the shaft and rotating the club until both of the outer markings are visible while no part of the central portion is visible to ensure that the striking face of the golf club is properly aligned relative to the intended path of ball travel.

10 Claims, 5 Drawing Sheets

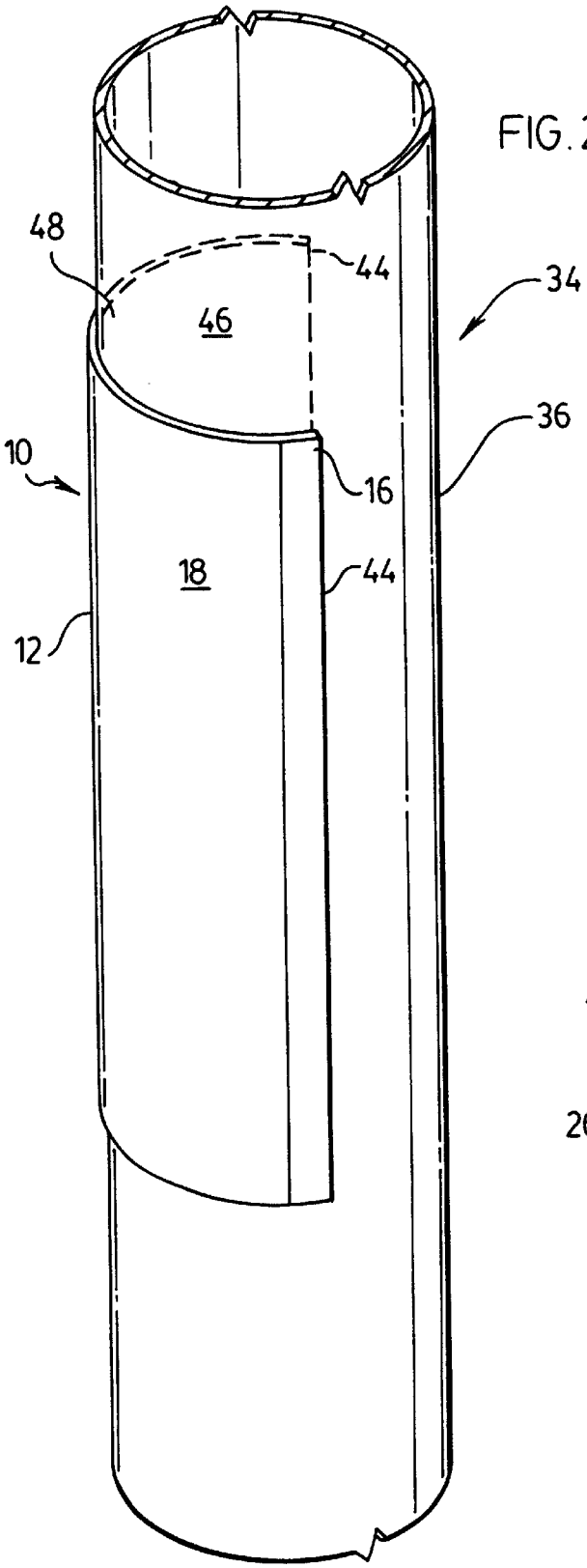
FIG. 2.
FIG. 3.
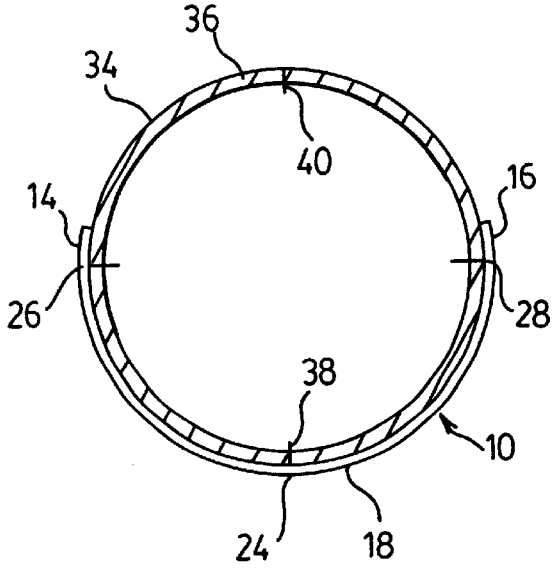

GOLF CLUB ALIGNMENT DEVICE

FIELD OF THE INVENTION

This invention relates to golf, and more specifically to devices for properly aligning the head of a golf club relative to an intended path of ball travel, as well as golf clubs incorporating such devices.

BACKGROUND OF THE INVENTION

In the game of golf, proper alignment of the head of the club relative to the intended path of ball travel is very important. In order to hit the ball in a desired direction, it is necessary to maintain the striking face of the club normal to the intended path of travel as the club strikes the ball. If the striking face is not normal to the direction of travel, the ball will travel either to the right or left of the intended direction of travel.

It is known to provide alignment markings on the head of a golf putter to permit the golfer to properly align the putter head relative to the intended path of ball travel. One such device is described in U.S. Pat. No. 5,564,990 to Weeks, issued on Oct. 15, 1996. Weeks describes a golf putter in which the upper surface of the heel portion of the putter head is provided with first and second alignment markings parallel to the striking surface of the putter. The alignment markings extend along either side of the base of the shaft such that, when the putter head is properly aligned, the golfer's line of sight will show the alignment markings being parallel to the putter shaft.

Although the putter alignment system described by the Weeks patent has been found to be effective, it can only be used with clubs having a heel portion projecting rearwardly of the shaft, and is not generally applicable to all golf clubs. To the inventor's knowledge, there does not exist an effective alignment system which is generally applicable to all golf clubs, including putters, irons, woods and drivers.

Furthermore, the alignment system described by Weeks is applicable only to putters having a heel portion of specific dimension and shape. Therefore, the Weeks alignment system is likely to be available only with the purchase of a specially designed putter, and is generally unsuitable for application to existing clubs.

Therefore, the need exists for an improved golf club alignment system.

SUMMARY OF THE INVENTION

The present invention overcomes the disadvantages of the prior art by providing a system for aligning golf clubs which can be used with all golf clubs and which can be easily applied to new or existing clubs.

The present invention provides a golf club alignment device to be secured to an outer surface of a golf club shaft. The device comprises a band of material having first and second markings positioned at first and second ends of a central portion, the markings being of contrasting visual appearance relative to the central portion of the band, with the markings preferably being light in colour and the central portion of the band preferably being dark in colour. The contrasting visual appearance of the markings and the central portion create visual transition points between the markings and the central portion of the band.

The transition points between the markings and the central portion of the band are spaced apart by a distance such that, when the band is applied to the cylindrical surface of the golf club shaft with the center point of the central portion coincident with the rearmost point of the shaft, the transition points are located at 180 degrees to one another and at 90 degrees to the rearmost point on the shaft.

Therefore, when the device is installed on the golf club shaft, the central portion of the band extends about the rear face of the shaft, while the contrasting markings wrap around the front face of the shaft. The golfer aligns the club by sighting down along the front face of the shaft and rotating the club until both of the outer markings are visible while no part of the central portion is visible. Aligning the shaft in this manner ensures that the striking face of the golf club is properly aligned relative to the intended path of ball travel, improving the likelihood that the ball will travel in the desired direction.

BRIEF DESCRIPTION OF THE DRAWINGS

The invention will now be described, by way of example only, with reference to the accompanying drawings, in which:

FIG. 2 is a perspective view of a device according to the present invention applied to the shaft of a golf club;

FIG. 3 is a cross-sectional view along the line III—III of FIG. 2;

DETAILED DESCRIPTION OF PREFERRED EMBODIMENTS

Figure 1:
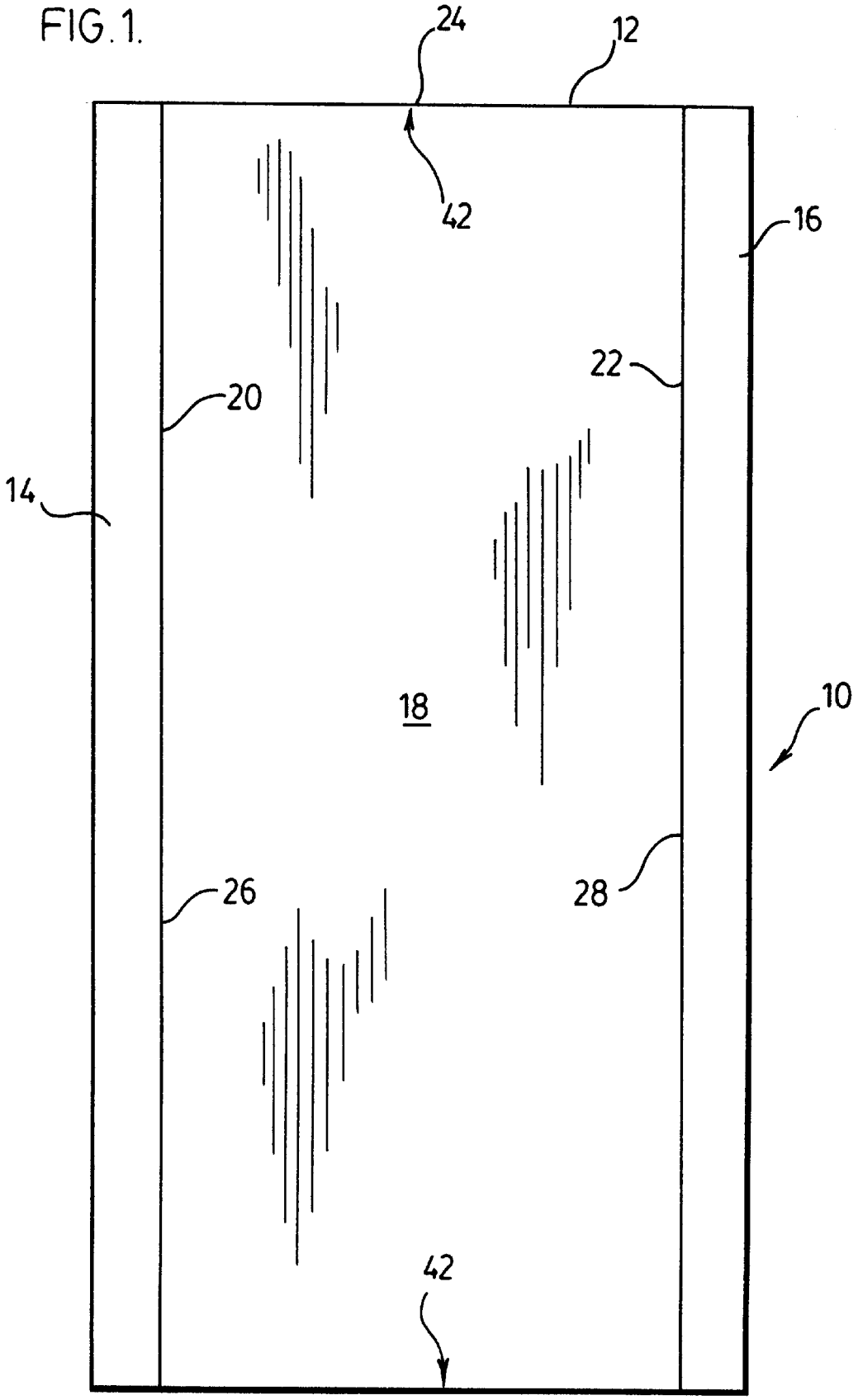
FIG. 1 is a front elevational view of a golf club alignment device according to the present invention in a flattened configuration.

Referring to the accompanying drawings, a preferred golf club alignment device 10 according to the present invention is shown in FIG. 1 in a flattened configuration for ease of description. The preferred alignment device 10 comprises a band of material 12 having first and second outer markings 14 and 16 at respective first and second ends 20 and 22 of a central portion 18, the central portion 18 having a center point 24 midway between its two ends 20 and 22.

In the preferred device shown in the drawings, the band 12, outer markings 14, 16 and central portion 18 are each shown as being rectangular in shape, with a width (along the horizontal direction in FIG. 1) of band 12 being less than its length (vertical direction in FIG. 1). In one particularly preferred embodiment, for use with a golf club having a shaft with outside diameter of 0.37 inches, the width of the band 12 is preferably about 20 mm and the length of the band 12 is preferably about 40 mm.

Figure 4:
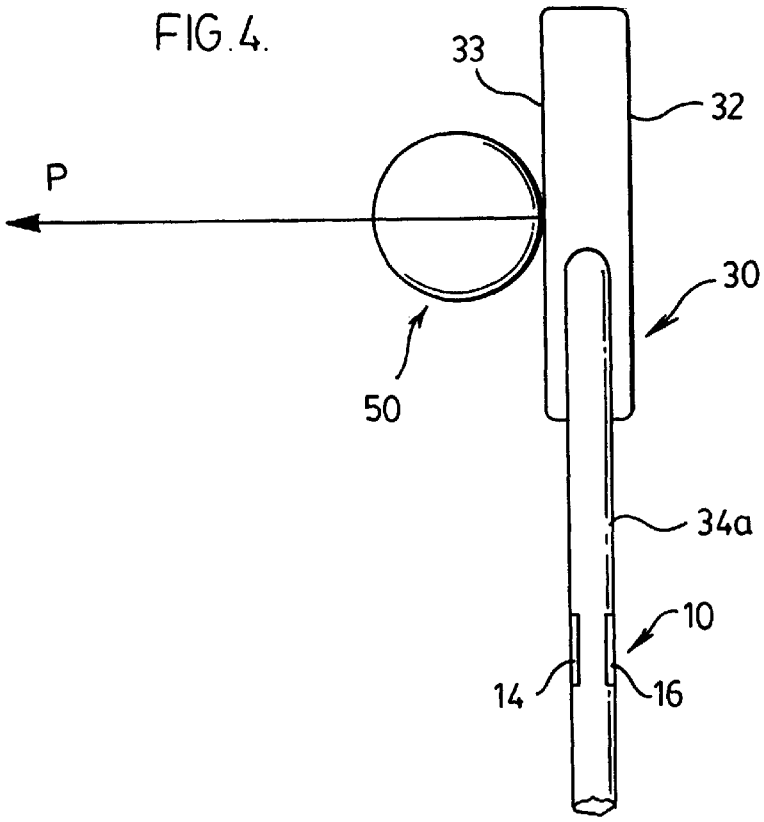
FIG. 4 is a top view of a putter having a device according to the present invention applied to its shaft with the putter face normal to the intended path of travel.

It will be appreciated that the shapes and dimensions of device 10 shown in the drawings and described herein are preferred, and not essential, and that the principles of the present invention can be applied to devices having various sizes and shapes, and in which the markings 14 and 16 have various sizes and shapes. However, it is particularly preferred that the outer markings 14 and 16 are rectangular in shape greater in length than in width so that they will appear as straight lines parallel to the shaft of the club when viewed along the line of sight of the golfer as seen in FIG. 4.

The outer markings 14 and 16 are of contrasting visual appearance relative to the central portion 18 of band 12 in order to form first and second visual transition points 26 and 28 at the first and second ends 20 and 22 of central portion 18. These transition points 26 and 28 in the preferred embodiment shown in the drawings comprise a pair of parallel lines along which the outer markings 14 and 16 meet the central portion 18. These transition points 26 and 28 are clearly visible to the golfer to allow proper alignment of the club.

Preferably, the contrasting visual appearance of the markings 14, 16 and the central portion 18 is provided by a colour contrast between the outer markings 14, 16 and the central portion 18. Preferably, the colours of the outer markings 14, 16 and the central portion 18 are clearly visible against the surface of the shaft, which is usually a bright metallic colour. It is particularly preferred that the outer markings 14, 16 be lighter in colour than the central portion 18, and even more preferred that the outer markings 14, 16 are white. Most preferably, the outer markings 14, 16 are white and the central portion 18 is red.

It will be understood that references to the central portion 18 contrasting in colour to the outer markings 14, 16 includes embodiments in which only portions of the central portion 18 proximate the transition points 26 and 28 are of a contrasting colour.

FIGS. 2 and 3 illustrate device 10 having been applied to a golf club having a cylindrical shaft 34 extending between the head (not shown) and handle grip portion (not shown). The shaft has an outer surface 36, and has a rearmost point 38 arranged at 180 degrees relative to a forwardmost point 40.

As shown in FIG. 2, the band 12 is wrapped around the outer surface 36 of shaft 34 so that the center point 24 of the central portion 18 is coincident with the reannost point 38 of the shaft 34. The distance between the transition points 26 and 28, measured along the horizontal direction of FIG. 1, is such that the transition points 26 and 28 are positioned at 180 degrees to one another and at 90 degrees to the rearmost point 38 on the shaft 34. In preferred embodiments of the invention in which the band 12 has negligible or small thickness, the central portion 18 will have a width measured between its ends 20, 22 of one half the circumference of the shaft 34. In the particularly preferred embodiment for use with a golf club with a shaft diameter of 0.37 inches, the central portion preferably has a width of about 14 to 16 mm and the outer markings comprise narrow rectangular lines each having a width of about 2 mm and a length of about 40 mm.

In the preferred device 10 shown in the drawings in which the outer markings are rectangular, the lines on which transition points 26, 28 are located are parallel to one another and are also parallel to the shaft 34. As mentioned above, providing outer markings 14, 16 in the form of narrow, parallel lines assists the golfer in properly aligning the club.

Preferably, the device 10 is applied to a golf club using an alignment device (not shown) to accurately locate the rearmost point 38 of the shaft 34. Such an alignment device could preferably take the form of a fixture to hold the club stationary and a laser device which locates the rearmost point 38 on the shaft relative to the striking face. Once the position of the rearmost point 38 is determined, the device 10 is applied such that the center point 24 of central portion 18 is coincident with the rearmost point 38. In order to effectively align the device 10, at least one alignment marking is provided in the central portion 18 of the band 12 to mark the location of the center point 24. Preferably, two such alignment marks 42 are provided. When both marks 42 are aligned with the rearmost point 38 of shaft 34, the device 10 is accurately positioned so that the rectangular outer markings 14 and 16 will be properly positioned on the shaft 34 and parallel to the shaft 34.

As shown in FIG. 2, the band 12 is preferably C-shaped and has ends 44 which converge toward each other. The C-shape is such that the band 12 extends more than half way, but not completely, around the circumference of the shaft 34. Accordingly, the total width of the band 12 is greater than one half of the circumference of the shaft 34 and a distance between the ends of the band 12 is less than the circumference of the shaft 34.

Furthermore, the band 12 is preferably formed from a rigid material such as metal or plastic, with the thickness of the band 12 being such that the band 12 is somewhat resilient to allow the ends 44 of the band 12 to be separated to a distance slightly greater than the outside diameter of the shaft 34. This allows the rigid, C-shaped band 12 to be opened up for application to the shaft and the resilience of the band 12 causes it to then spring back and grip the outer surface 36 of shaft 34. Preferably, the inside diameter of the band 12 is substantially the same as the outside diameter of the shaft 34 so that the band 12 tightly grips the shaft 34 and does not move during use of the club.

In order to provide the required rigidity and resilience, the band 12 is preferably made of either plastic or metal, with metal being more preferred. Preferably, the thickness of the band 12 is such that it does not substantially protrude outwardly from the outer surface 36 of shaft 34. In ada particularly preferred embodiment, the band 12 is comprised of aluminum having a thickness of about 1 mm.

The band 12 preferably grips the shaft 34 of the club sufficiently that the band 12 does not become displaced during use of the club. However, the band 12 is preferably adjustable during and after installation. Therefore, the inner surface 46 of the band 12 is preferably provided with a thin layer 48 of a resilient, non-slip material. This material is preferably an elastomeric material such as natural or synthetic rubber.

Although the preferred embodiment of the invention has been described with reference to a device 10 comprising a rigid band 12 of material which tightly grips the shaft 34, alternate constructions of the device may also be preferred. For example, the device 10 may comprise an adhesive-backed decal which, prior to application, is flat and has the appearance of device 10 shown in FIG. 1.

Figure 5:
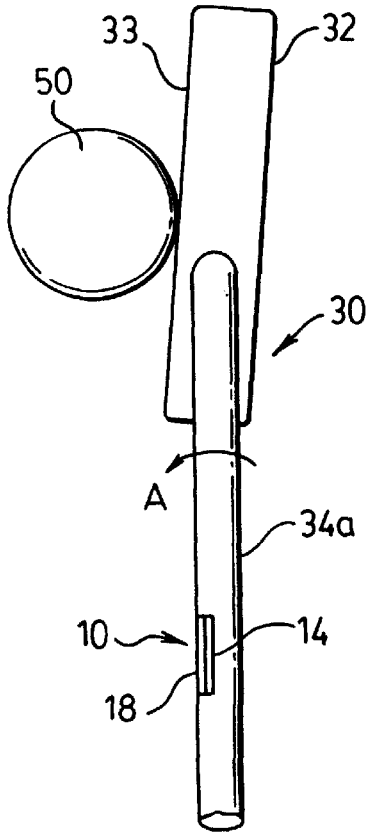
FIG. 5 is a top view of the putter of FIG. 4 with the putter face "open"
Figure 6:
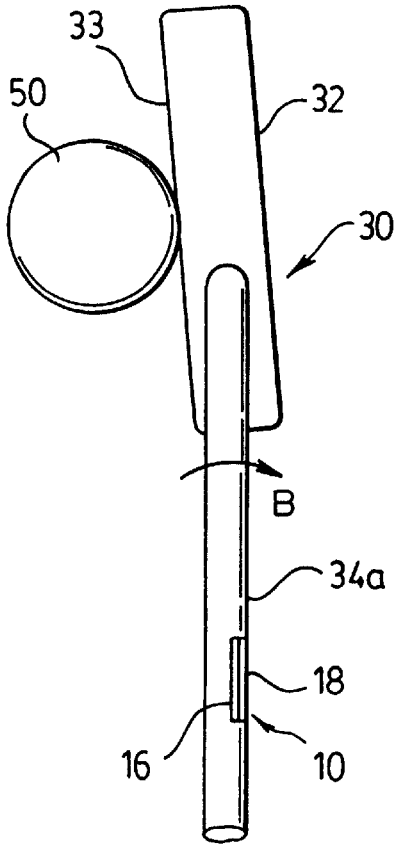
FIG. 6 is a top view of the putter of FIG. 4 with the putter face "closed"

It is a truism that, when a golf club head is correctly aligned with the intended path of travel of the ball, the striking face of the club head is normal to the intended path of travel. When the striking face is "open", it is inclined at an angle to the golfer's rear foot; and when the striking face is "closed", it is inclined at an angle toward the golfer's front foot. These various club attitudes are illustrated in FIGS. 4, 5 and 6 in the context of a putter and in FIGS. 7, 8 and 9 in the context of an iron. The clubs illustrated in FIGS. 4 to 9 each have a device 10 mounted to its shaft in the manner described above and illustrated in FIGS. 2 and 3. FIGS. 4 to 9 also indicate the changes in the indications given by device 10 to the golfer as the club attitude is changed.

FIG. 4 is a view along the golfer's line of sight of a putter 30 as it is striking a golf ball 50. Putter 30 has a head 32 with a striking face 33 and shaft 34*a* having a device 10 according to the invention mounted thereon. In FIG. 4, the striking face 33 of putter 30 is properly aligned to be normal to the intended path of travel P of golf ball 50. When the club head 32 has this attitude, the first and second outer markings 14 and 16 of device 10 are visible to the golfer along his or her line of sight, and the central portion 18 is completely hidden from view.

In FIG. 5, the striking face 33 of putter 30 is "open". In this configuration, the central portion 18 and first outer marking 14 are visible, and the second outer marking 16 is not visible. The attitude of the striking face 33 is then corrected to that shown in FIG. 4 by rotating the shaft in the direction shown by arrow A in FIG. 5. In FIG. 6, the striking face 33 of putter 30 is "closed". In this configuration, the central portion 18 and second outer marking 16 are visible and the first outer marking 14 is not visible. In order to correct the attitude of the club, the golfer rotates the shaft 34a in the direction of arrow B until the markings 14 and 16 are visible as in FIG. 4.

Figure 7:
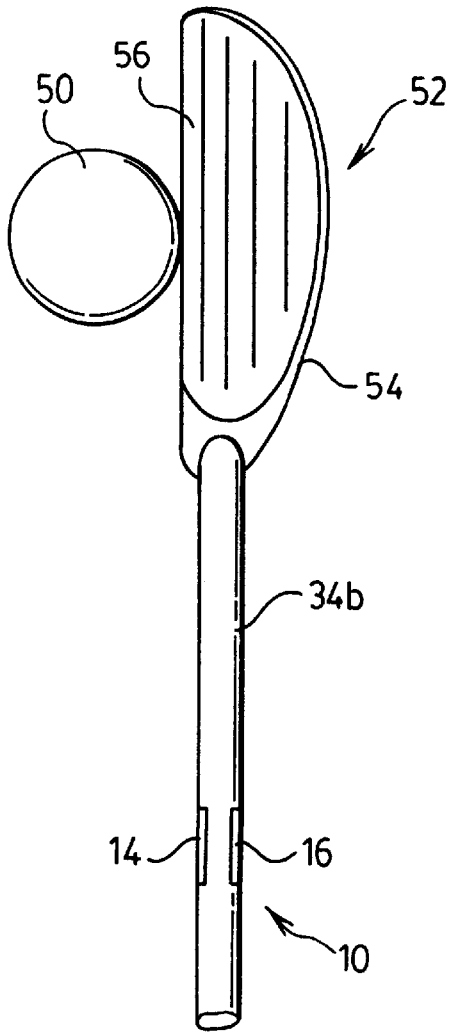
FIG. 7 is a top view of an iron having a device according to the present invention applied to its shaft with the striking face normal to the intended path of travel.
Figure 8:
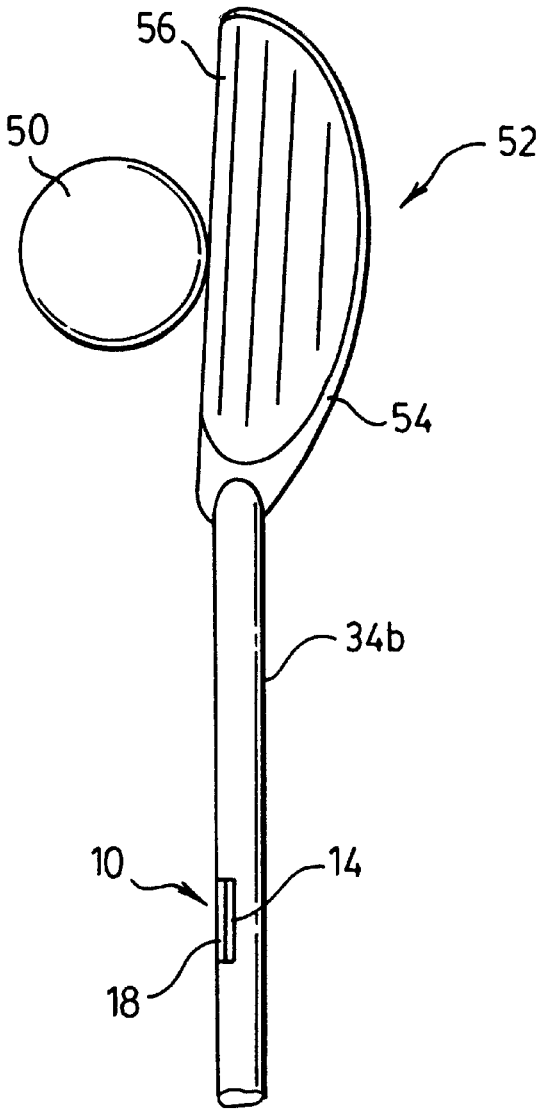
FIG. 8 is a top view of the iron of FIG. 7 with the striking face "open"
Figure 9:
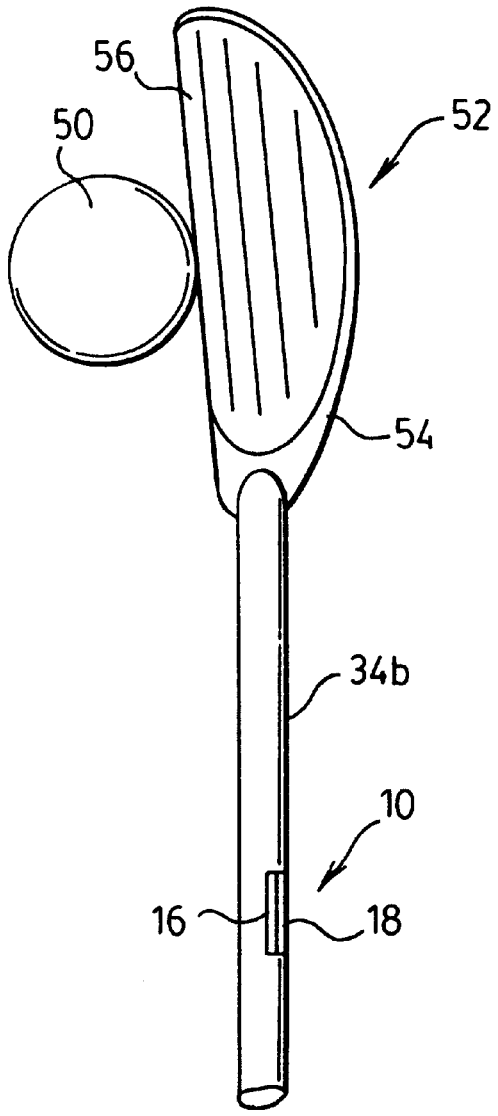
FIG. 9 is a top view of the iron of FIG. 7 with the striking face "closed".

FIGS. 7, 8 and 9 illustrate device 10 applied to an iron 52 having a shaft 34b and a head 54 with a striking face 56. As with putter 30, the iron 52 has the correct attitude when both markings 14 and 16 of device 10 are visible as shown in FIG. 7. The "open" and "closed" attitudes of iron 52 are shown in FIGS. 8 and 9, and can be corrected in the manner described above with reference to putter 30.

The present invention also includes within its scope golf clubs having shafts provided with alignment markings embodying the principles described above with reference to device 10. The shaft of such a club would be similar in appearance to the clubs described above having alignment device 10 applied thereto, with the exception that the markings would preferably be permanently affixed to the shaft. For example, such clubs may be provided with an adhesive-backed decal as described above with reference to device 10, or the markings may be applied directly to the outer surface of the shaft of the club.

Although the invention has been described in connection with certain preferred embodiments, it is not intended to be limited thereto. Rather, the invention includes all embodiments which may fall within the scope of the following claims.

What is claimed is:

1. A golf club alignment device to be secured to an outer surface of a golf club shaft, comprising:

a band of material having first and second outer markings positioned at respective first and second ends of a central portion, the central portion having a center point midway between its first and second ends;

each of said outer markings being of contrasting visual appearance relative to said central portion so as to form a first visual transition point at the first end of the central portion and a second visual transition point at the second end of the central portion;

the first and second transition points being spaced apart by a distance such that, when the band is applied to the outer surface of the shaft and with the center point coincident with a rearmost point on the shaft, the first and second transition points are located at 180 degrees to one another and at 90 degrees to the rearmost point on the shaft;

wherein the band is C-shaped and has ends which converge toward one another, a combined width of the central portion and the end portions being greater than one half the circumference of the shaft and a distance between the ends of the band being less than the circumference of the shaft.

2. The golf club alignment device according to claim 1, wherein the band is made of a rigid material and has a thickness such that the ends of the band can be separated to a distance greater than the outside diameter of the shaft.

3. The golf club alignment device according to claim 1, wherein the band is made of metal.

4. The golf club alignment device according to claim 1, wherein the band has an inside diameter substantially equal to the outside diameter of the shaft so as to tightly grip the shaft.

5. The golf club alignment device according to claim 3, wherein a layer of a resilient, slip-resistant material is applied to an inner surface of the band.

6. A golf club, comprising:

a head;

a shaft having first and second ends, the first end being connected to the head, the shaft having an outer surface;

a handle grip portion attached to the second end of the shaft; and alignment means applied to the shaft between the handle grip and the head, the alignment means comprising a plurality of alignment markings applied to the outer surface of the shaft, the alignment markings comprising a pair of outer marking means positioned at respective first and second ends of a central marking means having a center point midway between its first and second ends;

wherein each of the outer marking means being of contrasting visual appearance relative to the central marking means so as to form a first transition point at the first end of the central marking means and a second transition point at the second end of the central marking means;

the outer and central marking means being positioned on the outer surface of the shaft such that the center point of the central marking means is coincident with a rearmost point on the shaft, and the first and second transition points are located at about 180 degrees to one another and at about 90 degrees to the rearmost point on the shaft, such that when the shaft is viewed along a golfer's line of sight when the golf club is being used by the golfer to strike a golf ball, the golf club is properly aligned when both of the outer marking means are visible to the golfer and the central marking means is completely hidden from view; and wherein the alignment means is secured to the shaft such that, during use of the club, the golfer is able to simultaneously view the outer markings, the head of the club and the golf ball.

7. The golf club according to claim 6, wherein the outer marking means are of a first colour and the central marking means is of a second, contrasting colour.

8. The golf club according to claim 6, wherein the outer marking means are white and the central marking means is red.

9. The golf club according to claim 6, wherein the central marking means comprises a continuous, rectangular band.

10. The golf club according to claim 6, wherein the contrast in visual appearance between the outer marking means and the central marking means forms a first transition line at the first end of the central marking means and a second transition line at the second end of the central marking means, the first and second transition lines being parallel to one another and parallel to the shaft.

* * * * *